US007119763B2

(12) United States Patent
Okuda

(10) Patent No.: US 7,119,763 B2
(45) Date of Patent: Oct. 10, 2006

(54) LIGHT EMITTING CIRCUIT FOR ORGANIC ELECTROLUMINESCENCE ELEMENT AND DISPLAY DEVICE

(75) Inventor: Yoshiyuki Okuda, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 263 days.

(21) Appl. No.: 10/502,979

(22) PCT Filed: Jan. 24, 2003

(86) PCT No.: PCT/JP03/00626

§ 371 (c)(1),
(2), (4) Date: Jul. 30, 2004

(87) PCT Pub. No.: WO03/065334

PCT Pub. Date: Aug. 7, 2003

(65) Prior Publication Data

US 2005/0111505 A1 May 26, 2005

(30) Foreign Application Priority Data

Feb. 1, 2002 (JP) ..... 2002-025644
Feb. 1, 2002 (JP) ..... 2002-025645

(51) Int. Cl.
*G09G 3/30* (2006.01)

(52) U.S. Cl. ..... 345/36; 345/42; 345/48; 345/55; 345/84; 345/204

(58) Field of Classification Search ..... 345/36, 345/42, 48, 55, 76, 77, 84, 204, 205
See application file for complete search history.

(56) References Cited

U.S. PATENT DOCUMENTS

2001/0040536 A1* 11/2001 Tajima et al. ..... 345/55
2005/0057454 A1* 3/2005 Jang ..... 345/76

* cited by examiner

*Primary Examiner*—Bipin Shalwala
*Assistant Examiner*—Vincent E. Kovalick
(74) *Attorney, Agent, or Firm*—McGinn IP Law Group, PLLC

(57) ABSTRACT

A light emitting circuit and a display device capable of providing refresh action to an organic electroluminescence element to which a diode is connected in series, in a comparatively easy structure, in order to improve the average luminance.

14 Claims, 11 Drawing Sheets

FIG. 4

| OPERATING MODE | | POTENTIAL Pa | POTENTIAL Pb | POTENTIAL Pc | POTENTIAL Pd |
|---|---|---|---|---|---|
| SCANNING MODE | LIGHT EMISSION | ABOUT 10V | 0V | Vcc1 | ABOUT 7V |
| | NON-LIGHT EMISSION | 0V | 0V | Vcc1 | ABOUT 3V |
| LIGHT EMISSION CONTINUOUS MODE | | 0V | Vcc2 | Vcc1 | Vcc2 + 5V |
| REVERSE BIAS APPLICATION MODE | | 0V | Vcc2 | 0V | 0V |

FIG. 6

| OPERATING MODE | | OPERATING STATE | POTENTIAL Pa | POTENTIAL Pb | POTENTIAL Pc | POTENTIAL Pd |
|---|---|---|---|---|---|---|
| SCANNING MODE | LIGHT EMISSION | CURRENT SOURCE $33_1$: ACTIVE<br>SWITCH $43_1$: OFF | 10V | 0V | Vcc2 | ABOUT 7V |
| | NON-LIGHT EMISSION | CURRENT SOURCE $33_1$: INACTIVE<br>SWITCH $43_1$: ON | 0V | 0V | Vcc2 | ABOUT 3V |
| LIGHT EMISSION CONTINUOUS MODE | | STATE CORRESPONDING TO ANOTHER SCANNING LINE | 0V | Vcc3 | Vcc1 | Vcc3 + 5V |
| REVERSE BIAS APPLICATION MODE | | CURRENT SOURCE $33_1$: INACTIVE<br>SWITCH $43_1$: ON | 0V | Vcc3 | 0V | Vf |

FIG. 8

| OPERATING MODE | | OPERATING STATE | POTENTIAL Pa | POTENTIAL Pb | POTENTIAL Pc | POTENTIAL Pd |
|---|---|---|---|---|---|---|
| SCANNING MODE | LIGHT EMISSION | CURRENT SOURCE $33_1$: ACTIVE<br>SWITCH $43_1$: OFF | ABOUT 10V | Vcc3 | Vcc2 | Vcc3 + Vα − Vγ<br>(Vα = 7V) |
| | NON-LIGHT EMISSION | CURRENT SOURCE $33_1$: INACTIVE<br>SWITCH $43_1$: ON | 0V | Vcc3 | Vcc2 | Vcc3 + Vα − Vγ<br>(Vα = 3V) |
| LIGHT EMISSION CONTINUOUS MODE | | STATE CORRESPONDING TO ANOTHER SCANNING LINE | 0V | Vcc3 | Vcc1 | Vcc3 + Vα |
| REVERSE BIAS APPLICATION MODE | | CURRENT SOURCE $33_1$: INACTIVE<br>SWITCH $43_1$: ON | 0V | Vcc3 | 0V | Vf |

FIG. 10

| OPERATING MODE | | OPERATING STATE | POTENTIAL Pa | POTENTIAL Pb | POTENTIAL Pc | POTENTIAL Pd |
|---|---|---|---|---|---|---|
| SCANNING MODE | LIGHT EMISSION | CURRENT SOURCE $33_1$: ACTIVE<br>SWITCH $43_1$: OFF | ABOUT 10V | 0V | 0V | ABOUT 7V |
| | NON-LIGHT EMISSION | CURRENT SOURCE $33_1$: INACTIVE<br>SWITCH $43_1$: ON | 0V | 0V | 0V | ABOUT 3V |
| LIGHT EMISSION CONTINUOUS MODE | | STATE CORRESPONDING TO ANOTHER SCANNING LINE | 0V | Vcc | Vcc | Vcc + Vα |
| REVERSE BIAS APPLICATION MODE | | CURRENT SOURCE $33_1$: INACTIVE<br>SWITCH $43_1$: ON | 0V | Vcc | 0V | Vcc + Vβ |

FIG. 12

| OPERATING MODE | | OPERATING STATE | POTENTIAL Pa | POTENTIAL Pb | POTENTIAL Pc | POTENTIAL Pd |
|---|---|---|---|---|---|---|
| SCANNING MODE | LIGHT EMISSION | CURRENT SOURCE $33_1$: ACTIVE<br>SWITCH $43_1$: OFF | ABOUT 10V | Vcc | 0V | ABOUT 7V + Vcc |
| | NON-LIGHT EMISSION | CURRENT SOURCE $33_1$: INACTIVE<br>SWITCH $43_1$: ON | 0V | Vcc | 0V | ABOUT 3V + Vcc |
| LIGHT EMITTING MODE | LIGHT EMISSION | STATE CORRESPONDING TO ANOTHER SCANNING LINE | 0V | Vcc | Vcc | 7V + Vcc ~ 3V + Vcc |
| | NON-LIGHT EMISSION | | 0V | Vcc | 0V | 3V + Vcc |

LIGHT EMITTING CIRCUIT FOR ORGANIC ELECTROLUMINESCENCE ELEMENT AND DISPLAY DEVICE

TECHNICAL FIELD

The present invention relates to a light emitting circuit for an organic electroluminescence element and a display device.

BACKGROUND ART

An electroluminescence element (hereinafter referred to as 'EL element'), which is a capacitive light emitting element, can be electrically expressed as an equivalent circuit, as shown in FIG. 1. As can be understood from FIG. 1, an element can be substituted by a constitution of a capacity component C and a component E having a diode characteristic coupled in parallel to the capacity component. Therefore, an EL element can be considered to be a capacitive light emitting element. When a light emitting driving DC voltage is applied between the electrodes of the EL element, electric charge is accumulated in the capacity component C. When the voltage across the electrodes exceeds the barrier voltage or the light emission threshold voltage peculiar to the EL element, electric current starts flowing from the electrode (the anode side of the diode component E) to an organic functional layer forming a light emitting layer. As a result, the EL element emits light at light intensity proportional to the current.

The voltage V-current I-luminance L characteristic of the EL element is, as shown in FIG. 2, similar to the characteristic of a diode in that the current I is very small at a voltage lower than the light emission threshold voltage Vth and increases at a voltage higher than the light emission threshold voltage Vth. Further, the current I and the luminance L are nearly proportional to each other. The EL element shows light emitting luminance proportional to the current I which flows in accordance with a driving voltage V when the driving voltage applied to the EL element exceeds the light emission threshold voltage Vth, and shows no light emitting luminance when the driving voltage V applied to the EL element is equal to or lower than the light emission threshold voltage Vth.

When a voltage is applied to the EL element of which the function has deteriorated for repeated light emission, in a direction contrary to the forward direction, namely, a reverse bias voltage is applied, it is known that there is refresh action such that the function of the EL element is recovered.

As is also still known, in a light emitting circuit for making an EL element emit light, when a driving current is supplied to the EL element through a diode which is connected to the EL element in series, the EL element emits light, and then maintains the light emission by electric charge, which is accumulated in the capacitive component of the EL element in accordance with the driving current, for a while even after stopping the supply of the driving current. This phenomenon is can be effectively used in improving the average luminance of the EL element when a scanning time for every line is short in a display device for displaying through line scanning of a display panel with a plurality of EL elements arranged in a matrix shape, especially a display panel having a large number of lines.

In a light emitting circuit in which a diode is connected to an EL element in series, however, it is difficult to form a structure for applying a reserve bias voltage to the EL element to provide the refresh action.

DISCLOSURE OF INVENTION

An object of the present invention is to provide a light emitting circuit for an EL element and a display device capable of providing refresh action to the EL element where a diode is connected in series so as to improve the average luminance, in a comparatively easy structure.

According to the present invention, there is provided a light emitting circuit for making an organic electroluminescence element emit light in response to a light emission instruction, comprising: a first diode element connected with the organic electroluminescence element in a same polarity direction in series, a second diode element connected with said organic electroluminescence element at a connection point between said organic electroluminescence element and said first diode element, in a direction contrary to the polarity direction of the first diode element, driving current supplying means for supplying a driving current for light emission in the forward polarity direction to the serial circuit of said organic electroluminescence element and said first diode element in response to the light emission instruction, and reverse bias application means for applying a voltage to the serial circuit of said organic electroluminescence element and said second diode element in the direction contrary to the forward polarity direction of said organic electroluminescence element when said organic electroluminescence element does not emit light.

According to the invention, there is provided a display device comprising: a display panel in which a plurality of light emitting cells respectively including organic electroluminescence elements are arranged in a matrix shape; light emitting cell specifying means for specifying a least one light emitting cell to be driven to emit light of said light emitting cells in accordance with input image data; and driving means for making an organic electroluminescence element emit light, said organic electroluminescence element being in the light emitting cell specified by said light emitting cell specifying means, wherein said light emitting cell includes a first diode element connected with said organic electroluminescence element in a same polarity direction in series, and a second diode element connected with said organic electroluminescence element at a connection point between said organic electroluminescence element and said first diode element, in a direction contrary to the polarity direction of the first diode element, and said driving means includes driving current supplying means for supplying a driving current for light emission in the forward polarity direction to the serial circuit of said organic electroluminescence element and said first diode element in response to the light emission instruction, and reverse bias application means for applying a voltage to the serial circuit of said organic electroluminescence element and said second diode element in the direction contrary to the forward polarity direction of said organic electroluminescence element when said organic electroluminescence element does not emit light.

According to the present invention, there is provided a light emitting circuit for making an organic electroluminescence element emit light in response to a light emission instruction, comprising: a diode element connected with said organic electroluminescence element in a forward polarity direction in series; a capacitive element connected at the connection point of said organic electroluminescence element and said diode element; driving current supplying means for supplying a driving current in the forward direction to said organic electroluminescence element and said capacitive element through said diode element in response to the light emission instruction; and reverse bias application means for applying a voltage to the serial circuit of said organic electroluminescence element and said capacitive element in the direction contrary to the forward polarity direction of said organic electroluminescence element when said organic electroluminescence element does not emit light.

According to the present invention, there is provided a light emitting circuit for making an organic electroluminescence element emit light in response to a light emission instruction, comprising: a diode element connected with said organic electroluminescence element in a forward polarity direction in series; a capacitive element connected with said organic electroluminescence element at the connection point of said organic electroluminescence element and said diode element; first potential application means for applying a first potential, which is higher than a reference potential, to one end of said organic electroluminescence element on a side opposite to the connection point; driving current supplying means for supplying a driving current in the forward direction to said capacitive element through said diode element in response to the light emission instruction; and second potential application means for applying the first potential to one end of said capacitive element on a side opposite to said connection point, after finishing the supply of the driving current by said driving current supplying means.

According to the present invention, there is provided a display device comprising: a display panel in which a plurality of light emitting cells respectively including organic electroluminescence elements are arranged in a matrix shape; light emitting cell specifying means for specifying a least one light emitting cell to be driven to emit light of said light emitting cells in accordance with input image data; and driving means for making an organic electroluminescence element emit light, said organic electroluminescence element being in the light emitting cell specified by said light emitting cell specifying means, wherein said light emitting cell includes a diode element connected with said organic electroluminescence element in a forward polarity direction in series, and a capacitive element connected at the connection point of said organic electroluminescence element and said diode element, and said driving means includes driving current supplying means for supplying a driving current in the forward direction to said organic electroluminescence element and said capacitive element through said diode element in response to the light emission instruction, and reverse bias application means for applying a voltage to the serial circuit of said organic electroluminescence element and said capacitive element in the direction contrary to the forward polarity direction of said organic electroluminescence element when said organic electroluminescence element does not emit light.

According to the present invention, there is provided a display device comprising: a display panel in which a plurality of light emitting cells respectively including organic electroluminescence elements are arranged in a matrix shape; light emitting cell specifying means for specifying a least one light emitting cell to be driven to emit light of said light emitting cells in accordance with input image data; and driving means for making an organic electroluminescence element emit light, said organic electroluminescence element being in the light emitting cell specified by said light emitting cell specifying means, said light emitting cell includes a diode element connected with said organic electroluminescence element in a forward polarity direction in series, and a capacitive element connected with said organic electroluminescence element at the connection point of said organic electroluminescence element and said diode element, and said driving means includes first potential application means for applying a first potential, which is higher than a reference potential, to one end of said organic electroluminescence element on a side opposite to the connection point, driving current supplying means for supplying a driving current in the forward direction to said capacitive element through said diode element in response to the light emission instruction, and second potential application means for applying the first potential to one end of said capacitive element on a side opposite to said connection point, after finishing the supply of the driving current by said driving current supplying means.

BRIEF DESCRIPTION OF THE DRAWINGS

FIG. 4 shows a potential in each operation mode of each point of a light emitting cell of FIG. 3.

FIG. 6 shows a potential in each operation mode of each point of the light emitting cell of FIG. 5.

FIG. 8 shows a potential in each operation mode of each point of the light emitting cell of FIG. 7.

FIG. 10 shows a potential in each operation mode of each point of the light emitting cell of FIG. 9.

FIG. 12 shows a potential in each operation mode of each point of the light emitting cell of FIG. 11.

DETAILED DESCRIPTION OF THE INVENTION

Hereinafter, embodiments of the present invention will be described in details with reference to the drawings.

Figure 1:
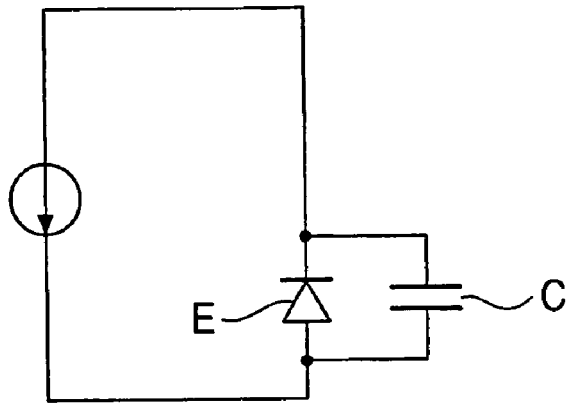
FIG. 1 shows an equivalent circuit of an EL element.
Figure 2:
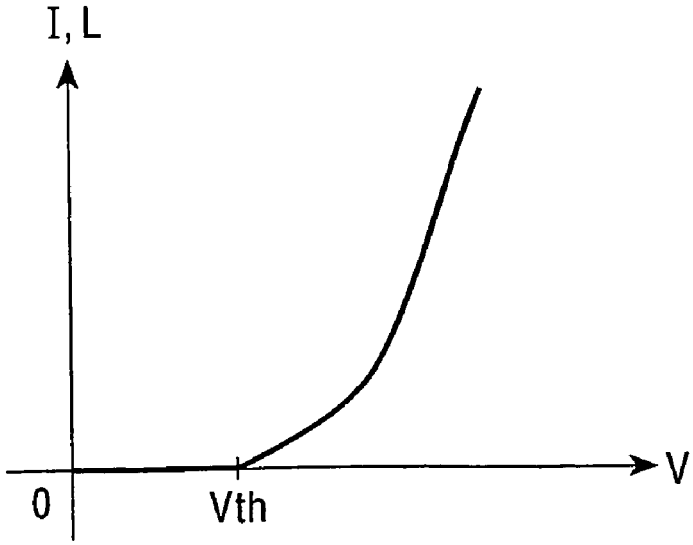
FIG. 2 schematically shows the driving voltage—current—luminance characteristic of the EL element.
Figure 3:
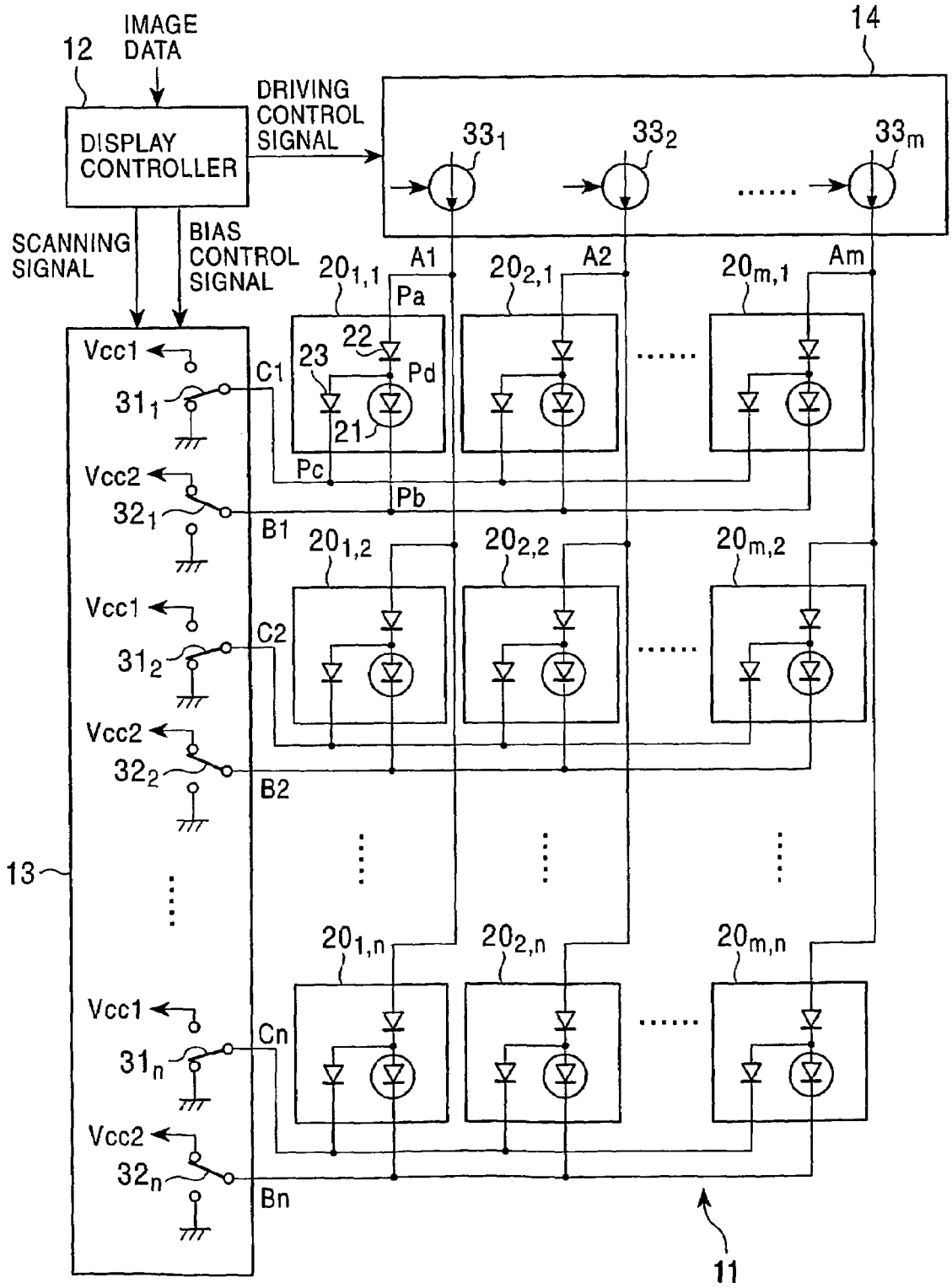
FIG. 3 is a block diagram showing an embodiment of the present invention.

FIG. 3 shows the structure of a display device to which the present invention is adopted. The display device comprises a display panel 11, a display controller 12, a scanning reverse bias circuit 13, and a driving current supplying circuit 14.

As illustrated in FIG. 3, the display panel 11 includes driving lines A1 to Am in the vertical direction and scanning lines B1 to Bn in the horizontal direction (line direction) being arranged in a matrix shape, and light emitting cells $\mathbf{20}_{1,1}$ to $\mathbf{20}_{m,n}$ in the respective intersections formed by the driving lines A1 to Am and the scanning lines B1 to Bn. The display panel 11 further includes reverse bias lines C1 to Cn in parallel to the respective scanning lines B1 to Bn.

The light emitting cells $\mathbf{20}_{1,1}$ to $\mathbf{20}_{m,n}$ all consist of the same components. Taking the light emitting cell $\mathbf{20}_{1,1}$ as an example, for the sake of explanation, it is provided with an EL element 21 and two diodes 22 and 23. The anode of the diode 22 is connected to the driving line A1 and the cathode thereof is connected to the positive electrode of the EL element 21 and the anode of the diode 23. The negative electrode of the EL element 21 is connected to the scanning line B1 and the cathode of the diode 23 is connected to the reverse bias line C1.

The display controller 12 generates a bias control signal, a driving control signal, and a scanning signal based on an input image data. The scanning signal is a signal for selecting one scanning line in turn, of the scanning lines B1 to Bn during one frame. The driving control signal is a signal for instructing supply of a driving current to at least one of the driving lines A1 to Am, corresponding to the EL element to be made emit light depending on the image data, of the EL elements of m light emitting cells on the one scanning line. The bias control signal is a signal for selecting one reverse bias line of the reverse bias lines C1 to Cn at a timing later than the scanning timing based on the scanning signal and instructing application of a reverse bias voltage to the EL elements of m light emitting cells on the one reverse bias line. The scanning signal and the bias control signal are supplied to a scanning reverse bias circuit 13 and the driving control signal is supplied to a driving current supplying circuit 14.

The scanning reverse bias circuit 13 includes reverse bias switches $\mathbf{31}_1$ to $\mathbf{31}_n$ and scanning switches $\mathbf{32}_1$ to $\mathbf{32}_n$, which are respectively connected to the reverse bias lines C1 to Cn and the scanning lines B1 to Bn. The reverse bias switches $\mathbf{31}_1$ to $\mathbf{31}_n$ are provided corresponding to the reverse bias lines C1 to Cn, so as to supply one of a potential Vcc1 and a ground potential (reference potential) selectively to the respective reverse bias lines C1 to Cn, in accordance with the bias control signal. The scanning switches $\mathbf{32}_1$ to $\mathbf{32}_n$ are provided corresponding to the scanning lines B1 to Bn, so as to supply one of a potential Vcc2 and the ground potential selectively to the respective scanning lines B1 to Bn, in accordance with the scanning signal. Here, Vcc1>Vcc2.

The driving current supplying circuit 14 includes current sources $\mathbf{33}_1$ to $\mathbf{33}_m$, which are respectively connected to the driving lines A1 to Am. The current sources $\mathbf{33}_1$ to $\mathbf{33}_m$ supply a driving current to at least one of the driving lines A1 to Am in accordance with the driving control signal.

In the display device constituted above, the operation in the case of making the EL element 21 of the light emitting cell $\mathbf{20}_{1,1}$ emit light by the display controller 12 will be described with reference to FIG. 4. In the description, a potential (potential of the driving line A1) applied to the anode end of the diode 22 is defined as Pa, a potential (potential of the scanning line B1) applied to the negative electrode of the EL element 21 is defined as Pb, a potential (potential of the reverse bias line C1) applied to the cathode end of the diode 23 is defined as Pc, and a potential applied to the positive electrode of the EL element 21 is defined as Pd, as illustrated in FIG. 3.

In the case of light emission of the EL element 21, there are a scanning mode for scanning the line of the light emitting cells $\mathbf{20}_{1,1}$ to $\mathbf{20}_{m,1}$, a light emission continuous mode for maintaining light emission of the EL element 21 just after finishing the scan, and a reverse bias application mode for applying a reverse bias voltage to the EL element 21, as operation modes of the light emitting cell $\mathbf{20}_{1,1}$, as illustrated in FIG. 4.

In the scanning mode, the reverse bias switch $\mathbf{31}_1$ and the scanning switch $\mathbf{32}_1$ each perform a switching operation in accordance with a scanning signal from the display controller 12, the reverse bias switch $\mathbf{31}_1$ relays the potential Vcc1 to the reverse bias line C1, and the scanning switch $\mathbf{32}_1$ relays the ground potential to the scanning line B1. Simultaneously with the relay operations, the current source $\mathbf{33}_1$ supplies the driving current to the driving line A1 in accordance with a driving control signal from the display controller 12.

Namely, since the diode 22 turns on, the driving current from the current source $\mathbf{33}_1$ flows into the ground through the driving line A1, the diode 22, the EL element 21, the scanning line B1, and the switch $\mathbf{32}_1$. The EL element 21 emits light by the flow of the driving current. Further, the driving current charges the capacitive component of the EL element 21.

The potential Pa of the driving line A1 becomes, for example, about 10V, the potential Pb of the scanning line B1 becomes 0V that is the ground potential, the potential Pc of the reverse bias line C1 becomes Vcc1, and the positive electrode potential Pd of the EL element 21 becomes about 7V. Since there is a relationship of Vcc1>Vcc2>7V, the diode 23 is in a reverse bias state, and electric charge is stored into the depletion layer capacitor of the diode 23.

When a scanning time assigned to the scanning line B1 passes, the contents of the scanning signal and the driving control signal from the display controller 12 are changed, the scan of the scanning line B1 is finished, and the selected scanning line is shifted to the scanning line B2. Thus, the light emission continuous mode is started. Since the scanning switch $\mathbf{32}_1$ performs a switching operation, the potential Vcc2 is relayed to the scanning line B1, and simultaneously, the current source $\mathbf{33}_1$ stops a supply of the driving current to the driving line A1.

In the light emission continuous mode, the potential Pa of the driving line A1 becomes 0V, the potential Pb of the scanning line B1 becomes Vcc2, and the potential Pc of the reverse bias line C1 remains at Vcc1. Since the capacitive component in the EL element 21 has accumulated charge, and the depletion layer capacitor of the diode 23 also has the accumulated charge, the accumulated charges flow into the diode component of the EL element 21 as a driving current in the forward direction, so as to maintain the light emission of the EL element 21. Accordingly, the positive electrode potential Pd of the EL element 21 becomes about Vcc2+5V. The EL element 21 stops the light emission when the voltage across the EL element 21 in the forward direction becomes lower than a light emission threshold voltage Vth in accordance with decrease of the accumulated charges.

When a bias control signal from the display controller 12 is generated, the reverse bias application mode is started. In the scanning reverse bias circuit 13, the reverse bias switch $\mathbf{31}_1$ performs a switching operation in response to the bias control signal so as to supply the ground potential 0V, instead of the potential Vcc1 to the reverse bias line C1. At this time point, since the positive electrode potential Pd of the EL element 21 is a potential level obtained by adding the potential Vcc2 at the potential Pb of the scanning line B1 and the potential of the residual charge of the EL element 21, the diode 23 turns on. By the turning-on of the diode 23, the positive electrode potential Pd is substantially changed to the ground potential 0V. Accordingly, the EL element 21 is in a reverse bias state and is provided with refresh action.

Even when the reverse bias switch $\mathbf{31}_1$ and the scanning switch $\mathbf{32}_1$ have performed the switching operation, in accordance with a scanning signal from the display controller 12 for the scan of the scanning line B1, in the scanning mode where the EL element 21 does not emit light, the current source $\mathbf{33}_1$ is in an inactive state and does not supply a driving current to the driving line A1. The positive electrode potential Pd at this time becomes about 3V.

Figure 5:
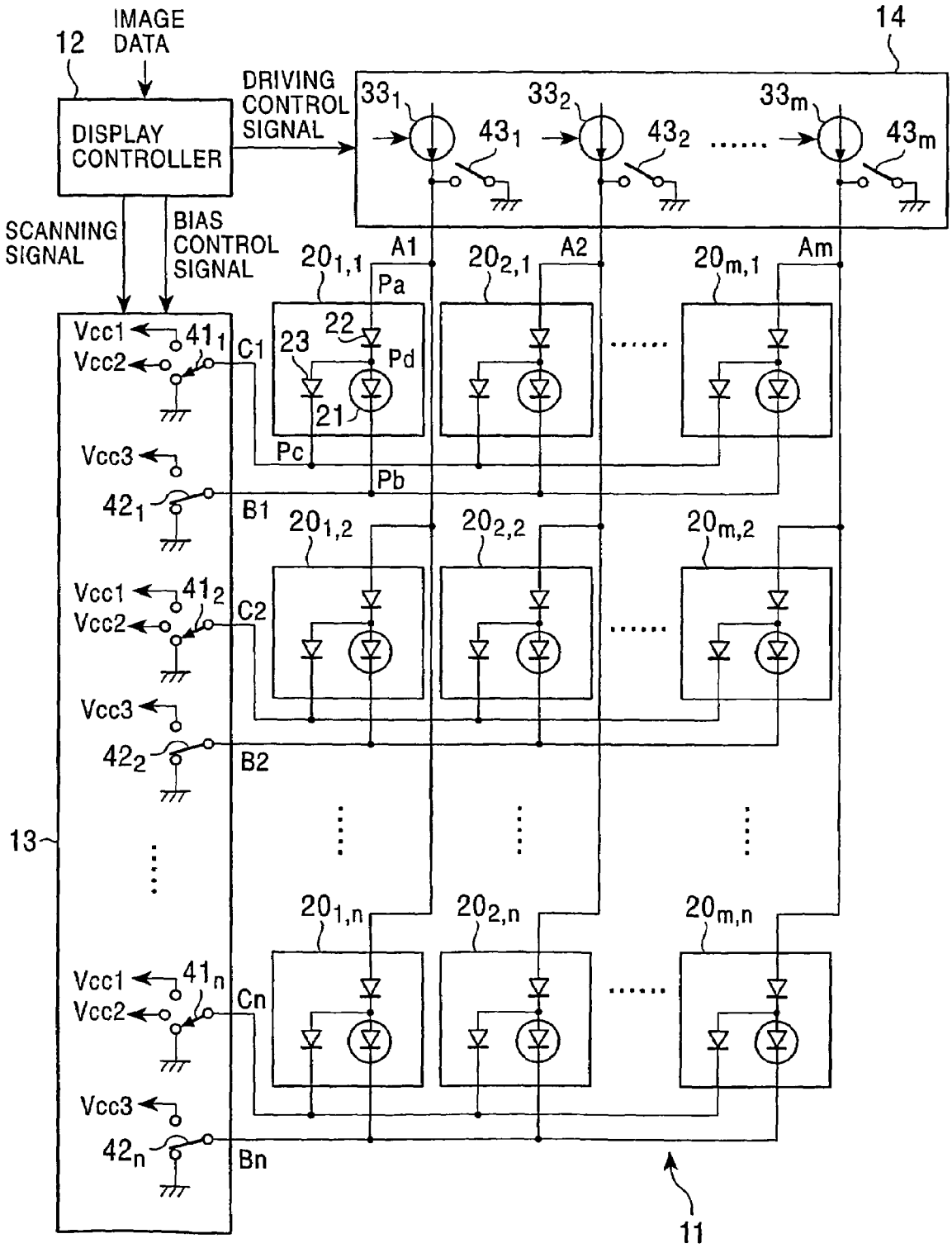
FIG. 5 is a block diagram showing another embodiment of the present invention.

FIG. 5 shows another embodiment of the present invention. A display device of FIG. 5 includes a display panel 11, a display controller 12, a scanning reverse bias circuit 13, and a driving current supplying circuit 14, similarly to the display device of FIG. 3. The display panel 11 and the display controller 12 are the same as those of FIG. 3.

The scanning reserve bias circuit 13 includes reverse bias switches $\mathbf{41}_1$ to $\mathbf{41}_n$ and scanning switches $\mathbf{42}_1$ to $\mathbf{42}_n$, which are respectively connected to the reverse bias lines C1 to Cn and the scanning lines B1 to Bn. The reverse bias switches $\mathbf{41}_1$ to $\mathbf{41}_n$ are provided corresponding to the reverse bias lines C1 to Cn, so as to supply one of a potential Vcc1, a potential Vcc2, and a ground potential selectively to the respective reverse bias lines C1 to Cn in response to a bias control signal. The scanning switches $\mathbf{42}_1$ to $\mathbf{42}_n$ are provided corresponding to the scanning lines B1 to Bn, so as to supply one of a potential Vcc3 and the ground potential selectively to the respective scanning lines B1 to Bn in accordance with a scanning signal. Here, there are relationships of Vcc1>Vcc2>Vcc3 and Vcc1−Vcc2=Vcc3.

The driving current supplying circuit 14 includes current sources $\mathbf{33}_1$ to $\mathbf{33}_m$ and switches $\mathbf{43}_1$ to $\mathbf{43}_m$, which are respectively connected to the driving lines A1 to Am. The current sources $\mathbf{33}_1$ to $\mathbf{33}_m$ supply a driving current to any of the driving lines A1 to Am in accordance with a driving control signal. The switches $\mathbf{43}_1$ to $\mathbf{43}_m$ are turned on to change the potentials of the driving lines A1 to Am to the ground potential respectively in response to the driving control signal.

In the display device constituted as shown in FIG. 5, the operation in the case where the display controller 12 makes the EL element 21 of the light emitting cell $\mathbf{20}_{1,1}$ emit light will be described with reference to FIG. 6. There are a scanning mode for scanning the line of the light emitting cells $\mathbf{20}_{1,1}$ to $\mathbf{20}_{m,1}$, a light emission continuous mode for maintaining light emission of the EL element 21 just after finishing the scan, and a reverse bias application mode for applying a reverse bias voltage to the EL element 21, as illustrated in FIG. 6.

In the scanning mode, the reverse bias switch $\mathbf{41}_1$ and the scanning switch $\mathbf{42}_1$ each perform a switching operation in accordance with a scanning signal from the display controller 12, the reserve bias switch $\mathbf{41}_1$ relays the potential Vcc2 to the reverse bias line C1, and the scanning switch $\mathbf{42}_1$ relays the ground potential to the scanning line B1. Simultaneously with these relay operations, in accordance with a driving control signal from the display controller 12, for the light emission of the EL element 21, the current source $\mathbf{33}_1$ operates to supply a driving current to the driving line A1 and the switch $\mathbf{43}_1$ is turned off.

Since the diode 22 turns on, the driving current from the current source $\mathbf{33}_1$ flows into the ground through the driving line A1, the diode 22, the EL element 21, the scanning line B1, and the switch $\mathbf{42}_1$. This flow of the driving current makes the EL element 21 emit light. The driving current charges the capacitive component of the EL element 21.

The potential Pa of the driving line A1 becomes, for example, about 10V, the potential Pb of the scanning line B1 becomes 0V that is the ground potential, the potential Pc of the reverse bias line C1 becomes Vcc2, and the positive electrode potential Pd of the EL element 21 becomes about 7V. Since there is a relationship of Vcc1>Vcc2>7V, the diode 23 is in a reverse bias state and electric charge is stored into the depletion layer capacitor of the diode 23.

When a scanning time assigned to the scanning line B1 passes, it turns into the light emission continuous mode. In the light emission continuous mode, the contents of the scanning signal and the driving control signal from the display controller 12 are changed, the scan of the scanning line B1 is finished, and the selected scanning line is shifted to the scanning line B2. Thus, the reverse bias switch $\mathbf{41}_1$ and the scanning switch $\mathbf{42}_1$ each perform a switching operation. The reverse bias switch $\mathbf{41}_1$ relays the potential Vcc1 to the reverse bias line C1, and the scanning switch $\mathbf{42}_1$ relays the potential Vcc3 to the scanning line B1. Simultaneously, the current source $\mathbf{33}_1$ stops the supply of the driving current to the driving line A1 and the switch $\mathbf{43}_1$ is turned on, alternatively, it supplies the driving current to the driving line A1 again, for the light emission of the EL element of the light emitting cell at the intersection of another selected scanning line and the driving line A1 and the switch $\mathbf{43}_1$ is turned off.

In the light emission continuous mode, when stopping the supply of the driving current to the driving line A1, the potential Pa of the driving line A1 becomes 0V, the potential Pb of the scanning line B1 increases to Vcc3, and the potential Pc of the reverse bias line C1 increases to Vcc1. Since the capacitive component in the EL element 21 has the accumulated charge and the depletion layer capacitor of the diode 23 also has the accumulated charge, the accumulated charges flow into the diode component of the EL element 21 as a driving current in the forward direction, so as to maintain the light emission of the EL element 21. Accordingly, the positive electrode potential Pd of the EL element 21 becomes about Vcc3+7V. The EL element 21 stops the light emission when the voltage across the EL element 21 in the forward direction becomes lower than the light emission threshold voltage Vth (for example, 3V) in accordance with a decrease of the accumulated charges. Thus, the light emission continuous mode is finished.

When the bias control signal from the display controller 12 is generated, the reverse bias application mode is started. In the reverse bias application mode, the reverse bias switch $\mathbf{41}_1$ in the scanning reverse bias circuit 13 performs a switching operation in response to the bias control signal from the display controller 12, so as to supply the ground potential 0V instead of the potential Vcc1 to the reverse bias line C1. At this time point, since the positive electrode potential Pd of the EL element 21 is a potential level obtained by adding the potential Vcc3 at the potential Pb of the scanning line B1 and the potential of the residual charge of the EL element 21, the diode 23 turns on. By the turning-on of the diode 23, the positive electrode potential Pd is substantially changed to a voltage Vf (for example, 1V to 2V) which is equal to the on-voltage of the diode 23. Since the positive electrode potential Pd is lower than the potential Vcc3 of the potential Pb, the EL element 21 is in a reverse bias state and is provided with refresh action.

Even when the reverse bias switch $\mathbf{41}_1$ and the scanning switch $\mathbf{42}_1$ have performed the switching operation in response to the scanning signal from the display controller 12, for the scan of the scanning line B1, in the scanning mode where the EL element 21 does not emit light, the current source $\mathbf{33}_1$ is in an inactive state and does not supply a driving current to the driving line A1 and the switch $\mathbf{43}_1$ is turned on. The positive electrode potential Pd at this time becomes about 3V.

Figure 7:
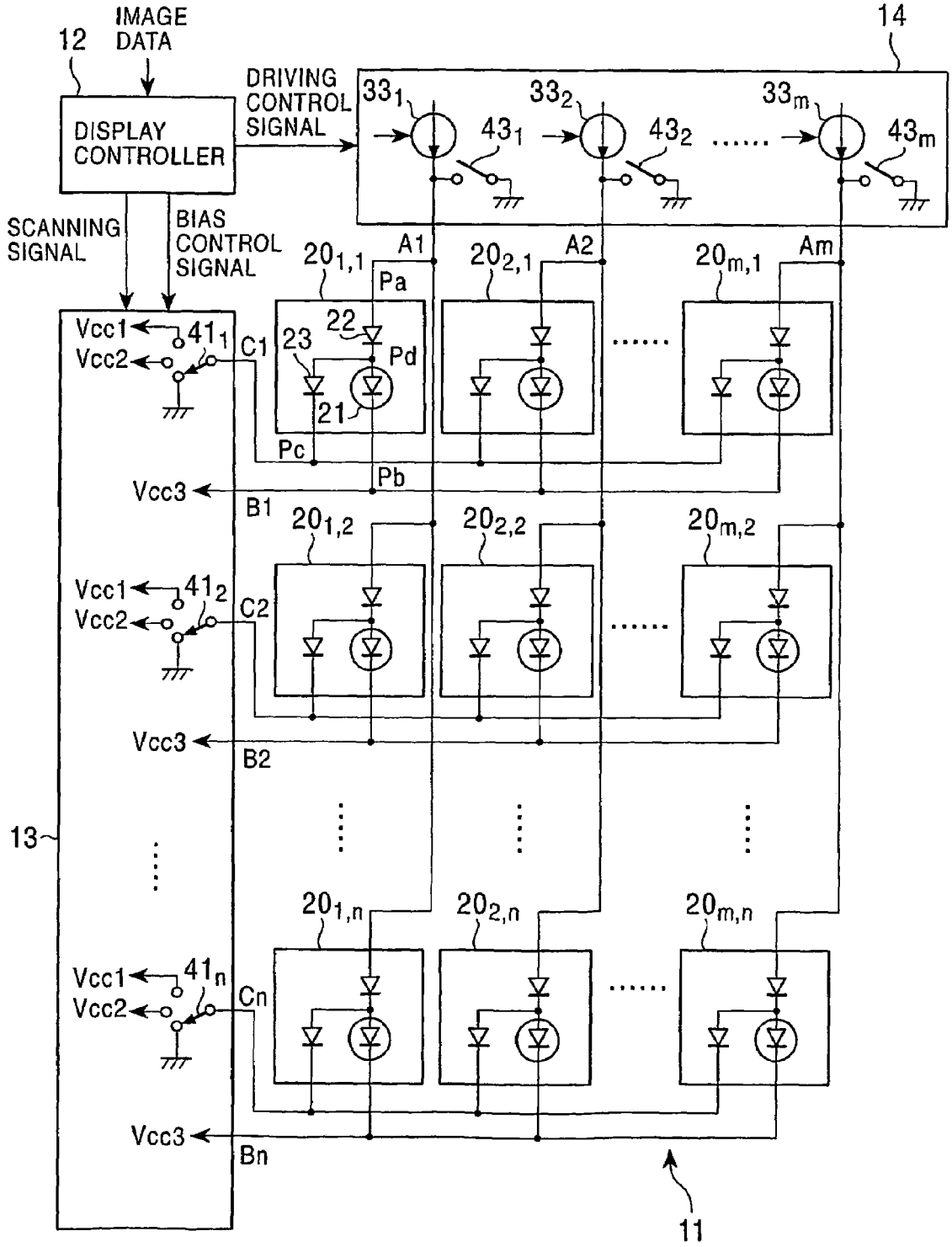
FIG. 7 is a block diagram showing another embodiment of the present invention.

FIG. 7 shows another embodiment of the present invention. A display device in FIG. 7 is designed so that the potential Vcc3 is always applied to the scanning lines B1 to Bn, without having the scanning switches $\mathbf{42}_1$ to $\mathbf{42}_n$ in the scanning reverse bias circuit 13 shown in FIG. 5. The other structure is the same as that of the display device of FIG. 5.

In the display device constituted as shown in FIG. 7, the operation in the case where the display controller 12 makes the EL element 21 of the light emitting cell $\mathbf{20}_{1,1}$ emit light will be described with reference to FIG. 8.

In the scanning mode, the reverse bias switch $\mathbf{41}_1$ performs a switching operation in accordance with a scanning signal from the display controller 12 so as to relay the potential Vcc2 to the reverse bias line C1. Simultaneously with the relay operation, in response to a driving control signal from the display controller 12, the current source $\mathbf{33}_1$ operates to supply a driving current to the driving line A1, for the light emission of the EL element 21, and the switch $\mathbf{43}_1$ is turned off.

Since the diode 22 turns on, the driving current from the current source $\mathbf{33}_1$ flows into the power source (not illustrated) of the potential Vcc3 through the driving line A1, the diode 22, the EL element 21, and the scanning line B1. This flow of the driving current makes the EL element 21 emit light. The driving current charges the capacitive component of the EL element 21.

The potential Pa of the driving line A1 becomes, for example, Vcc3+10V, the positive electrode potential Pd of the EL element 21 becomes about Vcc3+7V. Since there is a relationship of Vcc1>Vcc3+7V, the diode 23 is in a reverse bias state and electric charge is stored into the depletion layer capacitor of the diode 23.

When a scanning time assigned to the scanning line B1 passes, the contents of the scanning signal and the driving control signal from the display controller 12 are changed and the selected scanning line is shifted to the scanning line B2 though the potential of the scanning line B1 remains at Vcc3. Thus, the light emission continuous mode is started, and the reverse bias switch $\mathbf{41}_1$ performs a switching operation to relay the potential Vcc1 to the reverse bias line C1. Simultaneously with the switch operation, the current source $\mathbf{33}_1$ stops the supply of the driving current to the driving line A1 and the switch $\mathbf{43}_1$ is turned on, alternatively, it supplies the driving current to the driving line A1, for the light emission of the EL element of the light emitting cell at the intersection of another selected scanning line and the driving line A1 and the switch $\mathbf{43}_1$ is turned off.

In the light emission continuous mode, the potential Pa of the driving line A1 becomes 0V and the potential Pc of the reverse bias line C1 increases to Vcc1 when stopping the supply of the driving current to the driving line A1. Since the capacitive component in the EL element 21 has the accumulated charge and the depletion layer capacitor of the diode 23 also has the accumulated charge, the accumulated charges flow into the diode component of the EL element 21 as a driving current in the forward direction, so as to maintain the light emission of the EL element 21.

The positive electrode potential Pd of the EL element 21 is increased by $V\gamma = Vcc\mathbf{1} \times Cd\mathbf{23}/(Cd\mathbf{23}+Cell)$ by functioning the both capacities of the charged capacity Cell of the EL element 21 and the charged capacity Cd23 of the diode 23. The EL element 21 stops the light emission when the voltage in the forward direction of the EL element 21 becomes lower than the light emission threshold voltage Vth (for example, 3V) in accordance with to a decrease of the accumulated charges, thereby finishing the light emission continuous mode.

Assuming that the positive electrode potential Pd at the time of maintaining the light emission of the EL element 21 is $V\gamma = Vcc\mathbf{3} + V\alpha$, the positive electrode potential Pd becomes $Vcc\mathbf{3} + V\alpha - V\gamma$ when the EL element 21 emits light at a selection of the next scanning line B1. Here, $V\alpha$ is about 7V.

When the bias control signal is generated from the display controller 12, the reverse bias application mode is started. In the reverse bias application mode, similarly to the device of FIG. 5, in the scanning reverse bias circuit 13, the reverse bias switch $\mathbf{41}_1$ performs the switching operation, according to a bias control signal and supplies the ground potential 0V, instead of the potential Vcc1, to the reverse bias line C1. At this point, since the positive electrode potential Pd of the EL element 21 is the potential level obtained by adding the potential Vcc3 at the potential Pb of the scanning line B1 and the potential of the residual charges, the diode 23 is turned on. By turning on the diode 23, the positive electrode potential Pd is changed to the potential (for example, 1 to 2 V) equal to the on-voltage of the diode 23. Since the positive electrode potential Pd is lower than Vcc3 at the potential Pb, the EL element 21 is in a reverse bias state and is provided with refresh action.

Even when the reverse bias switch $\mathbf{41}_1$ has performed the switching operation in accordance with a scanning signal from the display controller 12, for the scan of the scanning line B1, in the scanning mode where the EL element does not emit light, the current source $\mathbf{33}_1$ is in an inactive and does not supply a driving current to the driving line A1, and the switch $\mathbf{43}_1$ is turned on. The positive electrode potential Pd of the EL element 21 becomes $Vcc\mathbf{3} + V\alpha - V\gamma$. $V\alpha$ is about 3V.

In the above-mentioned respective embodiments, although one light emitting cell is shown per one pixel, three light emitting cells, that are a red light emitting cell, a green light emitting cell and a blue light emitting cell, are formed in one pixel, in a color display matrix typed display panel.

In the above embodiments, it is not necessary to supply a bias control signal from the display control circuit 12 for each scan. For example, the bias control signal may be supplied once every scans by a predetermined number of times.

Figure 9:
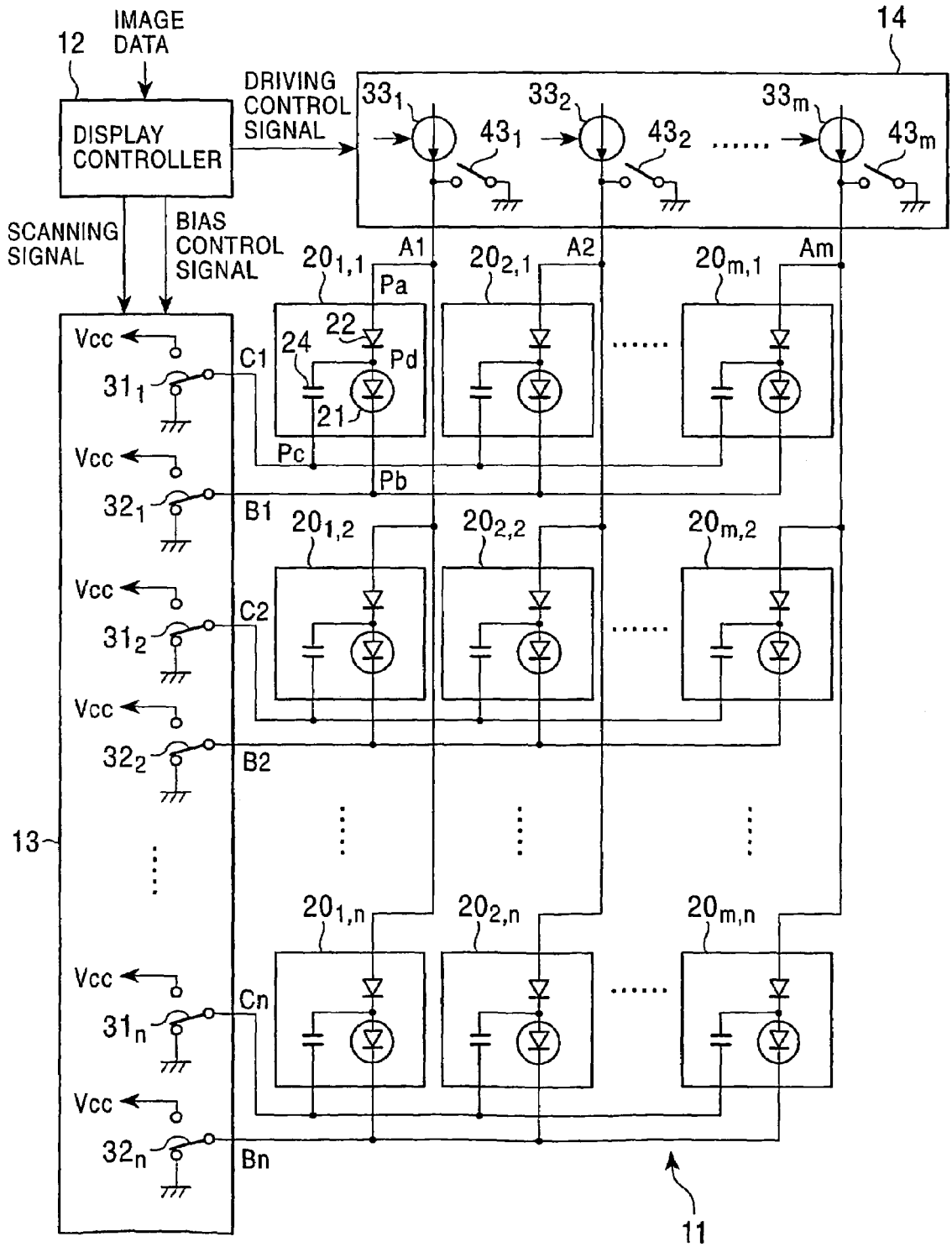
FIG. 9 is a block diagram showing another embodiment of the present invention.

FIG. 9 shows the structure of a display device to which the present invention is adopted. The display device includes a display panel 11, a display controller 12, a scanning reverse bias circuit 13, and a driving current supplying circuit 14, which are similar to the display device shown in FIG. 3.

As illustrated in FIG. 9, the display panel 11 includes driving lines A1 to Am in the vertical direction and scanning lines B1 to Bn in the horizontal direction (line direction) being arranged in a matrix shape, and light emitting cells $\mathbf{20}_{1,1}$ to $\mathbf{20}_{m,n}$ in the respective intersections formed by the driving lines A1 to Am and the scanning lines B1 to Bn. The display panel 11 further includes reverse bias lines C1 to Cn in parallel to the respective scanning lines B1 to Bn.

The light emitting cells $\mathbf{20}_{1,1}$ to $\mathbf{20}_{m,n}$ all consist of the same components. Taking the light emitting cell 201,1 as an example, for the sake of explanation, it is provided with an EL element 21, a diodes 22 and a capacitor 24. The anode of the diode 22 is connected to the driving line A1 and the cathode thereof is connected to the positive electrode of the EL element 21 and one end of the capacitor 24. The negative electrode of the EL element 21 is connected to the scanning line B1 and the other end of the capacitor 24 is connected to the reverse bias line C1.

The display controller 12 generates a bias control signal, a driving control signal, and a scanning signal based on an input image data. The scanning signal is a signal for selecting one scanning line in turn, of the scanning lines B1 to Bn during one frame. The driving control signal is a signal for instructing supply of a driving current to at least one of the driving lines A1 to Am, corresponding to the EL element to be made emit light depending on the image data, of the EL elements of m light emitting cells on the one scanning line. The bias control signal is a signal for selecting one reverse bias line of the reverse bias lines C1 to Cn at a timing later than the scanning timing based on the scanning signal and instructing application of a reverse bias voltage to the EL elements of m light emitting cells on the one reverse bias line. The scanning signal and the bias control signal are supplied to a scanning reverse bias circuit 13 and the driving control signal is supplied to a driving current supplying circuit 14.

The scanning reverse bias circuit 13 includes reverse bias switches $\mathbf{31}_1$ to $\mathbf{31}_n$ and scanning switches $\mathbf{32}_1$ to $\mathbf{32}_n$, which are respectively connected to the reverse bias lines C1 to Cn and the scanning lines B1 to Bn. The reverse bias switches $\mathbf{31}_1$ to $\mathbf{31}_n$ are provided corresponding to the reverse bias lines C1 to Cn, so as to supply one of a potential Vcc and a ground potential (reference potential) selectively to the respective reverse bias lines C1 to Cn, in accordance with the bias control signal. The scanning switches $\mathbf{32}_1$ to $\mathbf{32}_n$ are provided corresponding to the scanning lines B1 to Bn, so as to supply one of the potential Vcc and the ground potential selectively to the respective scanning lines B1 to Bn in accordance with the scanning signal. Here, there is a relationship of Vcc>7V.

The driving current supplying circuit 14 includes current sources $\mathbf{33}_1$ to $\mathbf{33}_m$ and switches $\mathbf{43}_1$ to $\mathbf{43}_m$, which are respectively connected to the driving lines A1 to Am. The current sources $\mathbf{33}_1$ to $\mathbf{33}_m$ supply a driving current to any of the driving lines A1 to Am in accordance with a driving control signal. The switches $\mathbf{43}_1$ to $\mathbf{43}_m$ respectively supply the ground potential to the driving lines A1 to Am in accordance with the driving control signal.

In the display device constituted above, the operation in the case of making the EL element 21 of the light emitting cell $\mathbf{20}_{1,1}$ emit light by the display controller 12 will be described with reference to FIG. 10. In the description, a potential (potential of the driving line A1) applied to the anode end of the diode 22 is defined as Pa, a potential (potential of the scanning line B1) applied to the negative electrode of the EL element 21 is defined as Pb, a potential (potential of the reverse bias line C1) applied to the other end of the capacitor 24 is defined as Pc, and a potential applied to the positive electrode of the EL element 21 is defined as Pd, as illustrated in FIG. 9.

In the case of light emission of the EL element 21, there are a scanning mode for scanning the line of the light emitting cells $\mathbf{20}_{1,1}$ to $\mathbf{20}_{m,1}$ a light emission continuous mode for maintaining light emission of the EL element 21 just after finishing the scan, and a reverse bias application mode for applying a reverse bias voltage to the EL element 21, as operation modes of the light emitting cell $\mathbf{20}_{1,1}$, as illustrated in FIG. 10.

In the scanning mode, the reverse bias switch $\mathbf{31}_1$ and the scanning switch $\mathbf{32}_1$ each perform a switching operation in accordance with a scanning signal from the display controller 12. The reverse bias switch $\mathbf{31}_1$ relays the ground potential 0V to the reverse bias line C1, and the scanning switch $\mathbf{32}_1$ relays the ground potential 0V to the scanning line B1. Simultaneously with the above relay operations, the current source $\mathbf{33}_1$ supplies a driving current to the driving line A1 in accordance with a driving control signal from the display controller 12, for the purpose of the light emission of the EL element 21, and the switch $\mathbf{43}_1$ is turned off.

Since the diode 22 turns on, the driving current from the current source $\mathbf{33}_1$ flows into the ground through the driving line A1, the diode 22, the EL element 21, the scanning line B1, and the switch $\mathbf{32}_1$. The EL element 21 emits light by the flow of the driving current. Further, the driving current charges the capacitive component of the EL element 21. Further, part of the driving current from the current source $\mathbf{33}_1$ flows into the ground through the diode 22, the capacitor 24, and the reverse bias switch $\mathbf{31}_1$, as a charging current, to charge the capacitor 24.

In the scanning mode, the potential Pa of the driving line A1 becomes, for example, about 10V, the potential Pb of the scanning line B1 and the potential Pc of the reverse bias line C1 become 0V that is the ground potential, and the positive electrode potential Pd of the EL element 21 becomes about 7V.

When a scanning time assigned to the scanning line B1 passes, the light emission continuous mode is started. In the light emission continuous mode, the contents of the scanning signal and the driving control signal from the display controller 12 are changed, the scan of the scanning line B1 is finished, and the selected scanning line is shifted to the scanning line B2. Thus, the reverse bias switch $\mathbf{31}_1$ and the scanning switch $\mathbf{32}_1$ each perform a switching operation. The reverse bias switch $\mathbf{31}_1$ relays the potential Vcc to the reverse bias line C1, and the scanning switch $\mathbf{32}_1$ relays the potential Vcc to the scanning line B1. Simultaneously with the switching operations, the current source $\mathbf{33}_1$ stops the supply of the driving current to the driving line A1 and the switch $\mathbf{43}_1$ is turned on, alternatively, it supplies a driving current to the driving line A1 for light emission of the EL element of the light emitting cell at the intersection of another selected scanning line and the driving line A1, and the switch $\mathbf{43}_1$ is turned off.

In the light emission continuous mode, when the supply of the driving current to the driving line A1 is stopped, the potential Pa of the driving line A1 becomes 0V and the diode 22 turns off. The potential Pb of the scanning line B1 and the potential Pc of the reverse bias line C1 increase to Vcc. Since the capacitive component in the EL element 21 has the accumulated charge and the capacitor 24 has the accumulated charges, the accumulated charges flow into the diode component of the EL element 21 as a driving current in the forward direction so as to maintain the light emission of the EL element 21. Accordingly, assuming that the positive electrode potential Pd of the EL element 21 is about Vcc+Vα, Vα=7V. The EL element 21 stops light emission when the voltage across the EL element 21 in the forward direction becomes lower than the light emission threshold voltage Vth (for example, Vα=3V) in accordance with a decrease of the accumulated charges and the light emission continuous mode is finished.

When a bias control signal from the display controller 12 is generated, the reverse bias application mode is started. In the reverse bias application mode, the reverse bias switch $\mathbf{31}_1$ in the scanning reverse bias circuit 13 performs a switching operation in response to a bias control signal from the display controller 12 so as to supply the ground potential 0V instead of the potential Vcc to the reverse bias line C1. A change from the potential Vcc to 0V at the other end of the capacitor 24 on the side of the reverse bias line C1 means a change in the potential at the one end on the opposite side of the capacitor 24, namely, the positive electrode potential Pd of the EL element 21. The current source $\mathbf{33}_1$ stops the supply of the driving current to the driving line A1 and the switch $\mathbf{43}_1$ is turned on.

Assume that the positive electrode potential Pd of the EL element 21 after the potential change of the reverse bias line C1 is represented by Vα+Vβ. Vα=3V is maintained. Further, assuming that the charged capacity of the EL element 21 is Cell and the charged capacity of the capacitor 24 is C24, Vβ is a voltage obtained by dividing the potential Vcc by two charged capacities Cell and C24, namely Vβ=Vcc×

Cell/(Cell+C24). The forward voltage Vell between the terminals of the EL element 21 becomes Vα+Vβ−Vcc.

When the potential Vcc is set at a fairly high level and, for example, C24 is set two to four times larger than Cell so as to satisfy the relationship of C24>Cell, the voltage Vell between the terminals of the EL element 21 becomes lower than 0V. Thus, the EL element 21 is in a reverse bias state and is provided with refresh action.

In the reverse bias application mode, since the residual charges of the capacitor 24 and the EL element 21 remain as they are, the positive electrode potential Pd is maintained. When the reverse bias application mode is finished in accordance with a disappearance of the bias control signal from the display controller 12, the reverse bias switch $\mathbf{31}_1$ performs a switching operation to relays the potential Vcc to the reverse bias line C1 similarly to the case of the light emission continuous mode. The positive electrode potential Pd of the EL element 21 increases by Vcc and returns into a potential level obtained by adding the potential Vcc at the potential Pb of the scanning line B1 and the potential of the residual charges.

Even when the reverse bias switch $\mathbf{31}_1$ and the scanning switch $\mathbf{32}_1$ have performed the switching operation in accordance with a scanning signal from the display controller 12, for the scan of the scanning line B1, in the scanning mode where the EL element 21 does not emit light, the current source $\mathbf{33}_1$ is in an inactive and the switch $\mathbf{43}_1$ is in on. Thus, no driving current is supplied to the driving line A1. The positive electrode potential Pd at this time becomes about 3V.

In the above embodiments, it is not necessary to supply a bias control signal from the display controller 12 in every scan. For example, the bias control signal may be supplied once every scans by a predetermined number of times.

In the above-mentioned embodiments, the driving lines A1 to Am have the ground potential, respectively by the switches $\mathbf{43}_1$ to $\mathbf{43}_m$. At the inactive time of each of the current sources $\mathbf{33}_1$ to $\mathbf{33}_m$, if the output line thereof becomes the ground potential, the switches $\mathbf{43}_1$ to $\mathbf{43}_m$ are not necessary.

Figure 11:
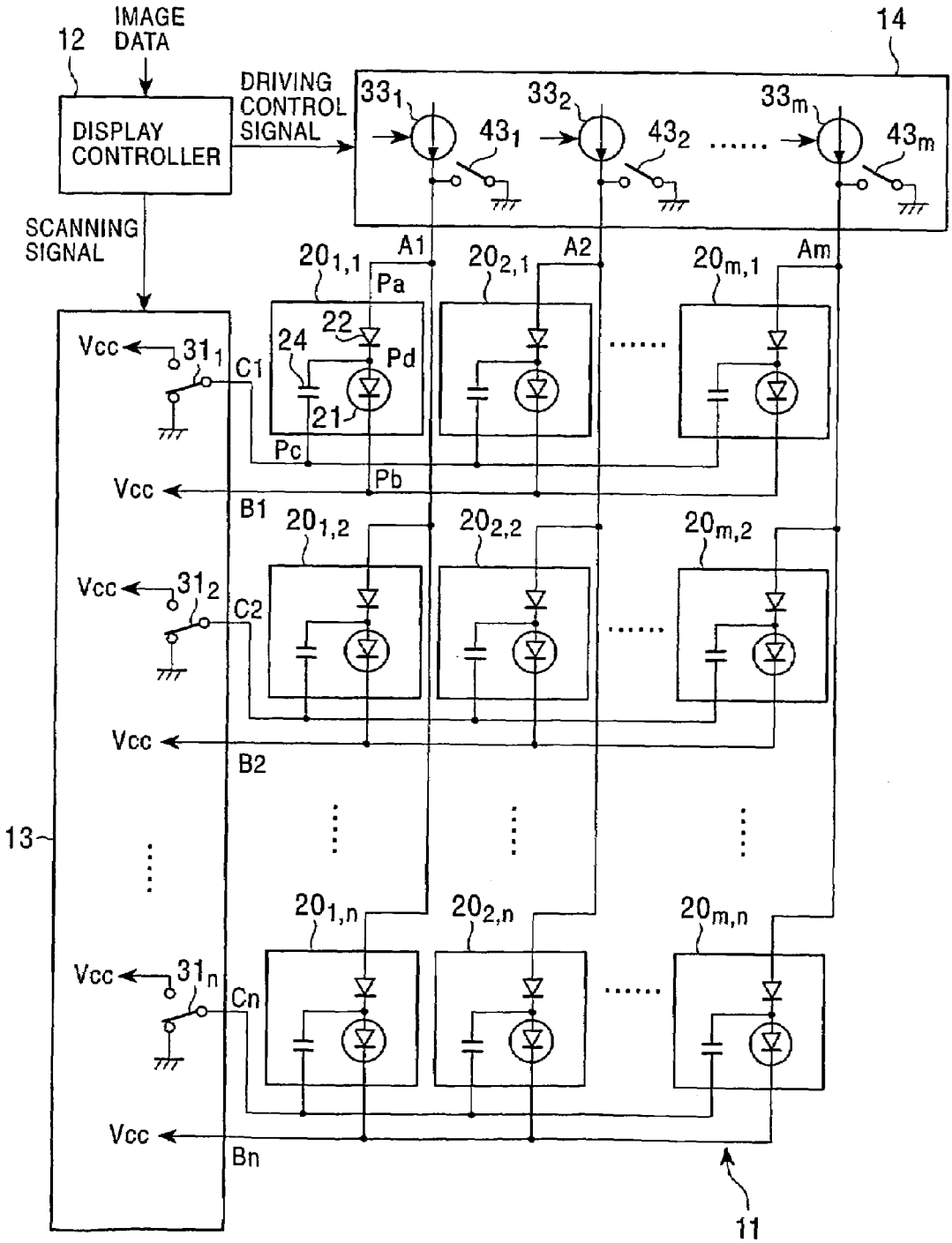
FIG. 11 is a block diagram showing another embodiment of the present invention.

FIG. 11 shows further another embodiment of the present invention. A display device of FIG. 11 does not includes the scanning switches $\mathbf{32}_1$ to $\mathbf{32}_n$ in the scanning reverse bias circuit 13 as mentioned in the display device of FIG. 9 and it is designed to always apply the potential Vcc to the scanning lines B1 to Bn. Although a scanning signal is supplied from the display controller 12 to the scanning reverse bias circuit 13, a bias control signal is not supplied. The other structure is the same as that of the display device of FIG. 9. It may be designed to apply the potential Vcc directly to the negative electrode lines of the EL elements of the light emitting cells $\mathbf{20}_{1,1}$ to $\mathbf{20}_{m,1}$ without passing through the scanning lines B1 to Bn.

In the display device constituted as shown in FIG. 11, the operation in the case where the display controller 12 makes the EL element 21 of the light emitting cell $\mathbf{20}_{1,1}$ emit light will be described with reference to FIG. 12.

In the case of light emission of the EL element 21 in FIG. 11, the operation mode of the light emitting cell $\mathbf{20}_{1,1}$ includes a scanning mode for scanning the line of the light emitting cells $\mathbf{20}_{1,1}$ to $\mathbf{20}_{m,1}$ and a light emitting mode of making the EL element 21 emit light just after finishing the scan, as illustrated in FIG. 12.

In the scanning mode, the reverse bias switch $\mathbf{31}_1$ performs a switching operation in accordance with a scanning signal from the display controller 12, to relay the potential Vcc to the reverse bias line C1. Simultaneously with the relay operation, the current source $\mathbf{33}_1$ supplies a driving current to the driving line A1 in accordance with a driving control signal from the display controller 12 to make the EL element 21 emit light and the switch $\mathbf{43}_1$ is turned off.

Since the diode 22 turns on, the driving current from the current source $\mathbf{33}_1$ flows into the ground through the driving line A1, the diode 22, the capacitor 24, the reverse bias line C1, and the reverse bias switch $\mathbf{31}_1$. Namely, the driving current charges the capacitor 24 as a charging current.

When the charging current flows, the negative electrode potential Pb of the EL element 21 is Vcc, while the positive electrode potential Pd is lower than Vcc and about 7V+Vγ. Therefore, the EL element 21 is in a reverse bias state and emits no light.

Assuming that the charged capacity of the EL element 21 is defined as Cell and that the charged capacity of the capacitor 24 is defined as C24, Vγ=Vcc×Cell/(Cell+C24). Vβ means that the potential Vcc is divided by the two charged capacities Cell and C24. When the potential Vcc is set at a fairly high level and, for example, C24 is set two to four times larger than Cell so as to satisfy the relation of C24>Cell, the voltage Vell between the terminals of the EL element 21 becomes about 7V+Vγ−Vcc which is lower than 0V. Therefore, the EL element 21 is in a reverse bias state and is provided with refresh action.

When a scanning time assigned to the line of the light emitting cells $\mathbf{20}_{1,1}$ to $\mathbf{20}_{m,1}$ passes, the contents of the scanning signal and the driving control signal from the display controller 12 are changed, the selected scanning line is shifted to the line of the light emitting cells $\mathbf{20}_{1,2}$ to $\mathbf{20}_{m,2}$ although the potential Pb remains at Vcc. Thus, the light emitting mode is started, the reverse bias switch $\mathbf{31}_1$ performs a switching operation to relay the potential Vcc to the reverse bias line C1. Simultaneously with the switching operation, the current source $\mathbf{33}_1$ stops the supply of the driving current to the driving line A1 and the switch $\mathbf{43}_1$ is turned on, alternatively, it supplies the driving current to the driving line A1, for the light emission of the EL element of the light emitting cell at the intersection of another selected scanning line and the driving line A1 and the switch $\mathbf{43}_1$ is turned off.

In the light emitting mode, the potential Pa of the driving line A1 becomes 0V and the potential Pc of the reverse bias line C1 rises up to Vcc when stopping the supply of the driving current to the driving line A1. The positive electrode potential Pd increases by a potential obtained by dividing the changed voltage Vcc of the potential Pc of the reverse bias line C1 according to the proportion of the two charged capacities Cell and C24, resulting in 7V+Vcc in accordance with a change from Vγ to Vcc. Since the voltage Vell between the terminals of the EL element 12 becomes about 7V, the EL element 21 emits light. When the voltage of the EL element 21 in the forward direction becomes lower than the light emission threshold voltage Vth (for example, 3V) in accordance with a decrease of the accumulated charges, the EL element 21 stops the light emission and the light emitting mode is finished.

Even when the reverse bias switch $\mathbf{31}_1$ has performed the switching operation in accordance with a scanning signal from the display controller 12, for the purpose of scanning the line of the light emitting cells $\mathbf{20}_{1,1}$ to $\mathbf{20}_{m,1}$ in the scanning mode where the EL element 21 does not emit light, the current source $\mathbf{33}_1$ is in an inactive and does not supply a driving current to the driving line A1 and the switch $\mathbf{43}_1$ is turned on. The positive electrode potential Pd of the EL element 21 becomes about 3V+Vγ and the EL element 21 turns into a reverse bias state. Thereafter, when a scanning time assigned to the line of the light emitting cells $\mathbf{20}_{1,1}$ to $\mathbf{20}_{m,1}$ passes and the selected scanning line is shifted to the line of the light emitting cells $\mathbf{20}_{1,2}$ to $\mathbf{20}_{m,2}$, the positive electrode potential Pd becomes 3V+Vcc.

In the above-mentioned respective embodiments, although one light emitting cell per one pixel is shown, three light emitting cells, namely, a red light emitting cell, a green light emitting cell, and a blue light emitting cell are formed per one pixel in a color display matrix typed display panel.

Further, in the above-mentioned respective embodiments, although the operation of the light emitting cell $\mathbf{20}_{1,1}$ has been described, the operations of the other light emitting cells $\mathbf{20}_{1,2}$ to $\mathbf{20}_{m,n}$ are the same as above.

As mentioned above, according to the present invention, in order to improve the average luminance, refresh action can be provided to the EL element to which a diode is connected in series, in a comparatively easy structure.

The invention claimed is:

1. A light emitting circuit for making an organic electroluminescence element emit light in response to a light emission instruction, comprising:

a first diode element connected with the organic electroluminescence element in a same polarity direction in series, a second diode element connected with said organic electroluminescence element at a connection point between said organic electroluminescence element and said first diode element, in a direction contrary to the polarity direction of the first diode element, driving current supplying means for supplying a driving current for light emission in the forward polarity direction to the serial circuit of said organic electroluminescence element and said first diode element in response to the light emission instruction, and reverse bias application means for applying a voltage to the serial circuit of said organic electroluminescence element and said second diode element in the direction contrary to the forward polarity direction of said organic electroluminescence element when said organic electroluminescence element does not emit light.

2. A light emitting circuit according to claim 1, wherein said driving current supplying means includes a current source for supplying the driving current to one end of said first diode element on a side opposite to said connection point for a predetermined period in response to the light emission instruction, and first switching means for supplying a reference potential to one end of said organic electroluminescence element on a side opposite to said connection point when the driving current is supplied by said current source, and supplying a second potential, which is higher than the reference potential and lower than a first potential, to the one end of said organic electroluminescence element when the driving current is not supplied by said current source, and said reverse bias application means includes second switching means, after finishing the supply of the driving current by said current source, for supplying the first potential to one end of said second diode element on a side opposite to said connection point, and thereafter, supplying the reference potential to the one end of said second diode element on a side opposite to said connection point during a period when said organic electroluminescence element does not emit light.

3. A light emitting circuit according to claim 1, wherein said driving current supplying means includes a current source for supplying the driving current to one end of said first diode element on a side opposite to said connection point for a predetermined period in response to the light emission instruction, first switching means for supplying a reference potential to one end of said organic electroluminescence element on a side opposite to said connection point when the driving current is supplied by said current source, and supplying a third potential, which is higher than the reference potential, to the one end of said organic electroluminescence element when the driving current is not supplied by said current source, and a switch for supplying the reference potential to one end of said first diode element on a side opposite to said connection point when the driving current is not supplied by said current source, and said reverse bias application means includes second switching means for supplying a second potential, which is higher than the third potential, to one end of said second diode element on a side opposite to said connection point when the driving current is supplied by said current source, after finishing the supply of the driving current by said current source, supplying a first potential, which is higher than the second potential, to the one end of said second diode element, and thereafter, supplying the reference potential to the one end of said second diode element.

4. A light emitting circuit according to claim 1, wherein said driving current supplying means includes a current source for supplying the driving current to one end of said first diode element on a side opposite to the connection point for a predetermined period in response to the light emission instruction, means for supplying a third potential, which is higher than a reference potential, to one end of said organic electroluminescence element on a side opposite to said connection point, and a switch for supplying the reference potential to one end of said first diode element on a side opposite to the connection point when the driving current is not supplied by said current source, and said reverse bias application means includes second switching means for supplying a second potential, which is higher than the third potential, to one end of said second diode element on a side opposite to said connection point when the driving current is supplied by said current source, after finishing the supply of the driving current by said current source, supplying a first potential, which is higher than the second potential, to the one end of said second diode element, and thereafter, supplying the reference potential to the one end of said second diode element.

5. A display device comprising:

a display panel in which a plurality of light emitting cells respectively including organic electroluminescence elements are arranged in a matrix shape;

light emitting cell specifying means for specifying a least one light emitting cell to be driven to emit light of said light emitting cells in accordance with input image data; and driving means for making an organic electroluminescence element emit light, said organic electroluminescence element being in the light emitting cell specified by said light emitting cell specifying means, wherein said light emitting cell includes a first diode element connected with said organic electroluminescence element in a same polarity direction in series, and a second diode element connected with said organic electroluminescence element at a connection point between said organic electroluminescence element and said first diode element, in a direction contrary to the polarity direction of the first diode element, and said driving means includes driving current supplying means for supplying a driving current for light emission in the forward polarity direction to the serial circuit of said organic electroluminescence element and said first diode element in response to the light emission instruction, and reverse bias application means for applying a voltage to the serial circuit of said organic electroluminescence element and said second diode element in the direction contrary to the forward polarity direction of said organic electroluminescence element when said organic electroluminescence element does not emit light.

6. A display device according to claim 5, wherein said light emitting cell specifying means specifies said light emitting cell to be driven emit light by sequentially scanning a plurality of lines of said display panel.

7. A light emitting circuit for making an organic electroluminescence element emit light in response to a light emission instruction, comprising:

a diode element connected with said organic electroluminescence element in a forward polarity direction in series;

a capacitive element connected at the connection point of said organic electroluminescence element and said diode element;

driving current supplying means for supplying a driving current in the forward direction to said organic electroluminescence element and said capacitive element through said diode element in response to the light emission instruction; and reverse bias application means for applying a voltage to the serial circuit of said organic electroluminescence element and said capacitive element in the direction contrary to the forward polarity direction of said organic electroluminescence element when said organic electroluminescence element does not emit light.

8. A light emitting circuit according to claim 7, further comprising light emission maintaining means for maintaining a potential difference between both ends of the serial circuit of said organic electroluminescence element and said capacitive element substantially at zero after finishing the supply of the driving current by said driving current supplying means.

9. A light emitting circuit according to claim 7, wherein said driving current supplying means includes a current source for supplying the driving current to one end of said diode element on a side opposite to said connection point for a predetermined period in response to the light emission instruction, and first switching means for supplying a reference potential to one end of said organic electroluminescence element on a side opposite to the connection point when the driving current is supplied by said current source, and supplying a first potential, which is higher than the reference potential, to the one end of said organic electroluminescence element when the driving current is not supplied by said current source, and said reverse bias application means includes second switching means, after finishing the supply of the driving current by said current source, for supplying the first potential to one end of said capacitive element on a side opposite to said connection point, and thereafter, supplying the reference potential to the one end of said capacitive element during a period when said organic electroluminescence element does not emit light.

10. A light emitting circuit for making an organic electroluminescence element emit light in response to a light emission instruction, comprising:

a diode element connected with said organic electroluminescence element in a forward polarity direction in series;

a capacitive element connected with said organic electroluminescence element at the connection point of said organic electroluminescence element and said diode element;

first potential application means for applying a first potential, which is higher than a reference potential, to one end of said organic electroluminescence element on a side opposite to the connection point;

driving current supplying means for supplying a driving current in the forward direction to said capacitive element through said diode element in response to the light emission instruction; and second potential application means for applying the first potential to one end of said capacitive element on a side opposite to said connection point, after finishing the supply of the driving current by said driving current supplying means.

11. A display device comprising:

a display panel in which a plurality of light emitting cells respectively including organic electroluminescence elements are arranged in a matrix shape;

light emitting cell specifying means for specifying a least one light emitting cell to be driven to emit light of said light emitting cells in accordance with input image data; and driving means for making an organic electroluminescence element emit light, said organic electroluminescence element being in the light emitting cell specified by said light emitting cell specifying means, wherein said light emitting cell includes a diode element connected with said organic electroluminescence element in a forward polarity direction in series, and a capacitive element connected at the connection point of said organic electroluminescence element and said diode element, and said driving means includes driving current supplying means for supplying a driving current in the forward direction to said organic electroluminescence element and said capacitive element through said diode element in response to the light emission instruction, and reverse bias application means for applying a voltage to the serial circuit of said organic electroluminescence element and said capacitive element in the direction contrary to the forward polarity direction of said organic electroluminescence element when said organic electroluminescence element does not emit light.

12. A display device according to claim 11, wherein said light emitting cell specifying means specifies a light emitting cell to be driven emit light by sequentially scanning a plurality of lines of said display panel.

13. A display device according to claim 11, wherein said light emitting cell specifying means specifies a light emitting cell to be driven emit light by sequentially scanning a plurality of lines of said display panel.

14. A display device comprising:

a display panel in which a plurality of light emitting cells respectively including organic electroluminescence elements are arranged in a matrix shape;

light emitting cell specifying means for specifying a least one light emitting cell to be driven to emit light of said light emitting cells in accordance with input image data; and driving means for making an organic electroluminescence element emit light, said organic electroluminescence element being in the light emitting cell specified by said light emitting cell specifying means, said light emitting cell includes a diode element connected with said organic electroluminescence element in a forward polarity direction in series, and a capacitive element connected with said organic electroluminescence element at the connection point of said organic electroluminescence element and said diode element, and said driving means includes first potential application means for applying a first potential, which is higher than a reference potential, to one end of said organic electroluminescence element on a side opposite to the connection point, driving current supplying means for supplying a driving current in the forward direction to said capacitive element through said diode element in response to the light emission instruction, and second potential application means for applying the first potential to one end of said capacitive element on a side opposite to said connection point, after finishing the supply of the driving current by said driving current supplying means.

* * * * *